United States Patent [19]

Hicks

[11] Patent Number: 5,052,693

[45] Date of Patent: Oct. 1, 1991

[54] APPARATUS AND METHOD FOR GAME OF SKILL

[76] Inventor: Carl Hicks, 4 Ridgewood Avenue, Moncton, N.B., E1A 3N9, Canada

[21] Appl. No.: 616,352

[22] Filed: Nov. 21, 1990

[51] Int. Cl.[5] ..... A63B 67/06

[52] U.S. Cl. ..... 273/336; 273/400

[58] Field of Search ..... 273/336, 337, 338, 339, 273/398, 399, 400, 402, 424, 425, 348, 352

[56] References Cited

U.S. PATENT DOCUMENTS

| | | | |
|---|---|---|---|
| 2,147,502 | 2/1939 | Savage | 273/424 |
| 2,183,107 | 12/1939 | Savage | 273/400 |
| 4,877,256 | 10/1989 | Falloon | 273/400 |

FOREIGN PATENT DOCUMENTS

| | | | |
|---|---|---|---|
| 19699 | of 1897 | United Kingdom | 273/400 |

*Primary Examiner*—William H. Grieb

[57] ABSTRACT

A game apparatus, comprising a target and a projectile, the target being comprised of a series of cylinders of decreasing diameter to be arranged one above another, the difference in diameter of ascending cylinders being greater than the diameter of the projectile, each cylinder having a base, means to space each cylinder relative to the ascending cylinder so as to leave an open area about each cylinder adapted to receive the projectile, a post extending centrally upwardly from the uppermost cylinder and the projectile adapted to be received over the post.

5 Claims, 2 Drawing Sheets

APPARATUS AND METHOD FOR GAME OF SKILL

This invention relates to a game of skill for one or more players. The game involves a target and a projectile. The target is comprised of a series of cylinders disposed in an ascending manner, the bottom cylinders having the largest diameter and each subsequent cylinder arranged in an ascending fashion having a smaller diameter than the cylinder below. A center pin passes through the center of the base of each cylinder I0 and extends upwardly above the uppermost cylinder.

Because of the decreasing diameter of the cylinders arranged in ascending order, each cylinder below the top cylinder presents an open upward outer area sufficently large to receive the projectile. The upper cylinder is totally open upwardly except for the central pin passing through the centers of the bases of ascending cylinders.

The projectile is doughnut shaped and is adapted to be received in the lateral open spaces created between the ascending cylinders or in the alternative the opening in the center of the projectile is adapted to be received about the upper extending part of the center pin.

It is, therefore, an object of the present invention to provide a game employing a projectile receiving target which includes a series of ascending cylinders of decreasing diameter, whose diameter decreases by more than the diameter of the projectile.

Another object of the invention is to provide a central pin which centralizes the ascending cylinders and extends above the top cylinder to form a central upper target for the projectile which is doughnut shaped.

Other objects will appear from the specification and drawing in which.

Figure 1:
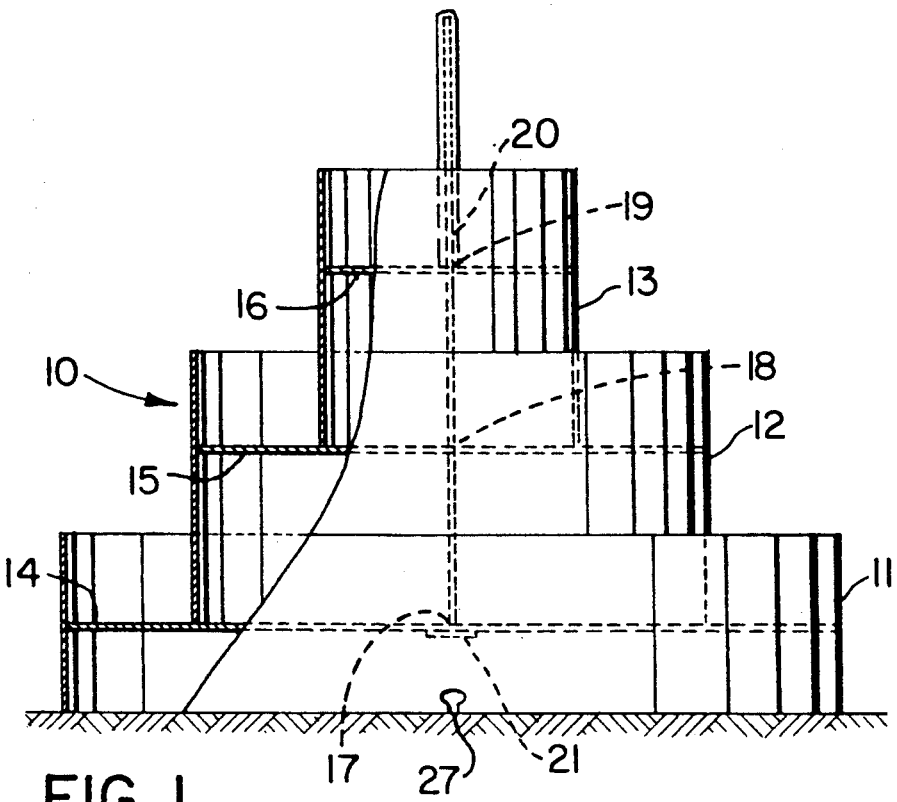
FIG. 1 is a side elevation view of the target.

Referring to FIG. 1, the target 10 is shown in its assembled arrangement. The target 10 is comprised of three cylinders 11, 12 and 13 arranged in ascending order. Each of the cylinders 11, 12 and 13 include respective bases 14, 15 and 16. The base 14 of cylinder 11 is disposed across the center of cylinder 11. The base 15 of cylinder 12 is disposed across the cylinder 12 at a position two thirds of the height from the bottom of cylinder 12. The base 16 of cylinder 13 is disposed across the cylinder 13 at a position two thirds of the height from the bottom of cylinder 13. The diameters of the ascending cylinders 12 and 13 decrease, the decrease in diameter between cylinders 11 and 12 and cylinders 12 and 13 being more than the diameter of the projectiles 50 used in the game.

The bases 14, 15 and 16 of cylinders 11, 12 and 13 contain central apertures 17, 18 and 19 adapted to receive a post 20. The post 20 extends through the apertures 17, 18 and 19. The post 20 includes a head 21. The post 20 is inserted through the central apertures 17, 18 and 19 of cylinders 11, 12 and 13 until head 21 sits against base 14. The post 20 is then fastened immediately above the base 16 of upper cylinder 13 by fastener which may incorporate any conventional fastening means.

Figure 2:
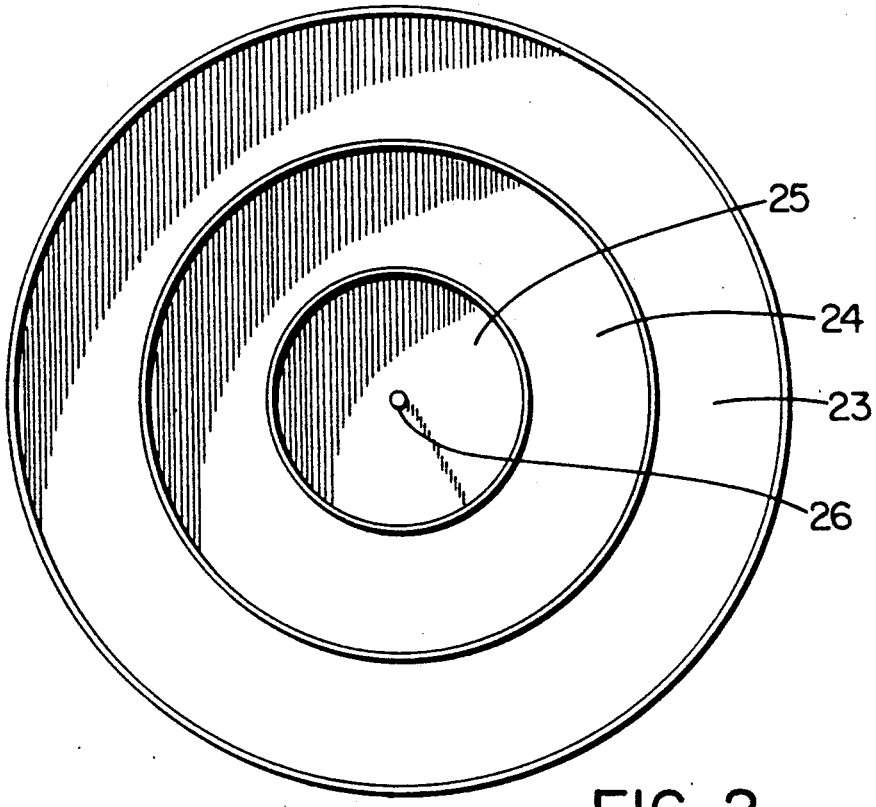
FIG. 2 is a top view of the target.

As seen in FIG. 2, the assembled target 10 presents a series of open areas 23, 24 and 25 and an upward extension 26 of post 20.

Referring to FIG. 1, a key shaped aperture 27 is shown near the bottom of the side wall of cylinder 11. Similar key shaped apertures are formed near the bottom of the side wall of cylinder 11 spaced about the bottom of cylinder 11 at 90° relative to the aperature.

Figure 3:
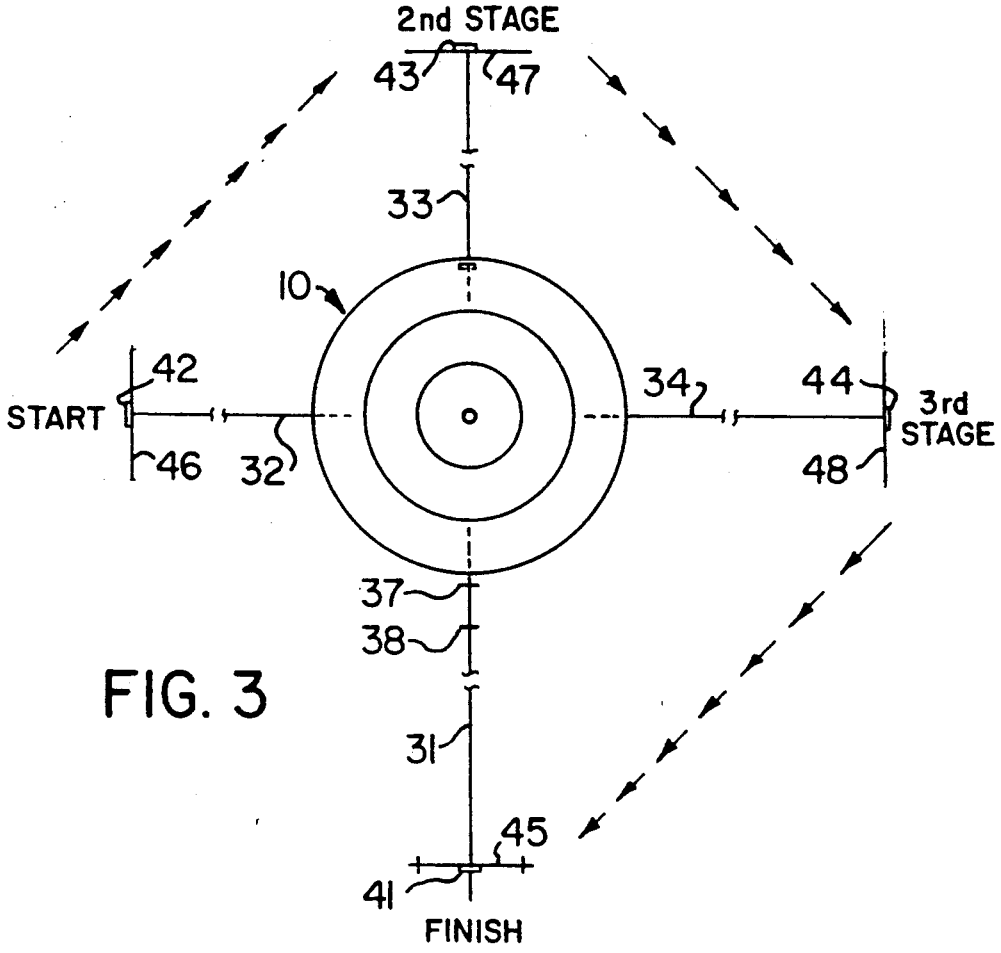
FIG. 3 is a top view of the game set up.

Referring to FIG. 3, ropes 31, 32, 33 and 34 are extended normally to the target from apertures 27, 28, 29 and 30.

Figure 4:
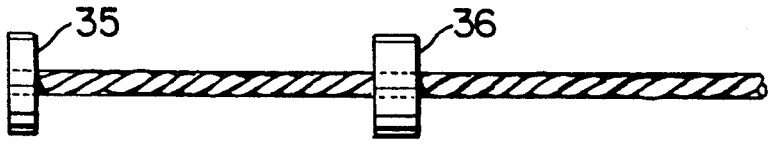
FIG. 4 is a detail of the rope and stops shown in FIG. 3.

As seen in FIG. 4 each of ropes 31, 32, 33 and 34 contain a number of stops 35, 36 which are fixed to the rope. The ropes 31, 32, 33 and 34 are fastened to target 10 by placing the stop 35 on each rope through the respective aperture 27, 28, 29 and 30 near the bottom of cylinder 11. The outer stops 36 etc. are spaced on rope 31, 32, 33 and 34 equal distances from the target to define the player,s throwing position during the game. The ropes 31, 32, 33 and 34 are adapted to receive staples 37, 38 as shown on page 31 which are installed in the ground near the target 10 to secure the target in position.

The end of each of ropes 31, 32, 33 and 34 include stops 41, 42, 43 and 44 which are adapted to receive rods 45, 46, 47 and 48 which define the outer throwing position for the players.

Figure 5:
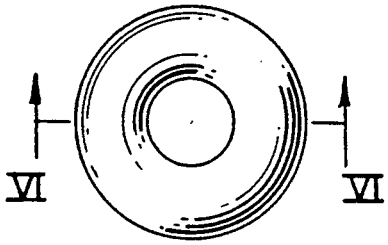
FIG. 5 is a top view of the projectile.
Figure 6:
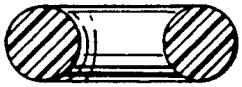
FIG. 6 is a sectional view along line 6—6 of FIG. 5.

Referring to FIG. 5 there is shown a side elevation view of the projectile 50. It will be seen that the projectile 50 has a central opening 51 adapted to fit over the top of post 20. As seen in FIG. 6, the projectile 50 has a doughnut shape.

The game may be shipped in a knockdown position and the target 10 may be assembled by the purchaser in the manner described above. The target 10 may then be placed in an open area. The ropes 31, 32, 33 and 34 may then be attached to the target 10 by placing the stop 35 on the I5 end of ropes 31, 32, 33 and 34 in the aperture 27 and corresponding apertures, not shown, spaced about the bottom of the cylinder 11. The ropes 31, 32, 33 and 34 are then extended normally from the target 10 and the ends of the ropes are then connected to rods 45, 46, 47 and 48 which are stapled to the surface on which the game is set up. The portion of the ropes near the target may also be stapled to the surface as shown at 37 and 38 thus securing the target 10 in place.

With the target 10 set up as described the players will stand at various stops on the ropes to release the projectile 50 at the target 10. The player will attempt at each stop to throw the projectile over the top of post 20, or into the open outer portion of cylinders 11 and 12 or open center portion of cylinder 13.

I claim:

1. A game apparatus, comprising a target and a projectile, said target being comprised of a series of cylinders of decreasing diameter to be arranged one above another, the difference in diameter of ascending cylinders being greater than the diameter of the projectile, each said cylinder having a base, means to space each cylinder relative to the ascending cylinder so as to leave an open area about each cylinder adapted to receive said projectile, a post extending centrally upwardly from said uppermost cylinder and said projectile adapted to be received over said post.

2. The game apparatus of claim 1 in which the base means of each cylinder contains a central aperture and said post extends through the central apertures to align the cylinders.

3. The game apparatus of claim 1 including apertures disposed at four equidistant points near the base of the lowermost cylinder, said apertures adapted to receive distance measuring devices extending normally from said apertures away from said target.

4. The game apparatus of claim 3 in which the distance measureing devices extending normally from said apertures include fixed stops at predetermined positions from said target.

5. The game apparatus of claim 4 in which the projectile is donut shaped.

* * * * *